US009639112B2

(12) United States Patent
Fuller

(10) Patent No.: US 9,639,112 B2
(45) Date of Patent: May 2, 2017

(54) MOUNTING ASSEMBLY FOR ELECTRONIC THROTTLE CONTROL ASSEMBLY

(71) Applicant: KSR IP Holdings, LLC, Wilmington, DE (US)

(72) Inventor: Shaun Fuller, Ridgetown (CA)

(73) Assignee: KSR IP Holdings, LLC, Wilmington, DE (US)

( * ) Notice: Subject to any disclaimer, the term of this patent is extended or adjusted under 35 U.S.C. 154(b) by 48 days.

(21) Appl. No.: 14/249,859

(22) Filed: Apr. 10, 2014

(65) Prior Publication Data

US 2014/0305256 A1 Oct. 16, 2014

Related U.S. Application Data

(60) Provisional application No. 61/810,452, filed on Apr. 10, 2013.

(51) Int. Cl.
*G05G 1/30* (2008.04)
*G05G 1/44* (2008.04)

(52) U.S. Cl.
CPC ..... *G05G 1/44* (2013.01); *Y10T 74/20528* (2015.01)

(58) Field of Classification Search
CPC ..... G05G 1/30; B60T 7/04
USPC ..... 74/512, 561; 248/314
See application file for complete search history.

(56) References Cited

U.S. PATENT DOCUMENTS

| | | | | |
|---|---|---|---|---|
| 3,776,649 | A * | 12/1973 | Kemezys | F16B 21/04 403/90 |
| 4,624,585 | A | 11/1986 | Nix et al. | |
| 6,176,340 | B1 | 1/2001 | Mizuma et al. | |
| 7,703,351 | B2 | 4/2010 | Sakuraba et al. | |
| 2004/0007884 | A1* | 1/2004 | Gras | B60T 11/18 292/300 |
| 2009/0293666 | A1 | 12/2009 | Kim et al. | |
| 2010/0319480 | A1* | 12/2010 | Nebuya | G05G 1/36 74/513 |
| 2014/0338492 | A1* | 11/2014 | Yokoi | G05G 1/30 74/513 |

FOREIGN PATENT DOCUMENTS

| | | | | |
|---|---|---|---|---|
| FR | 2834089 | A1 * | 6/2003 | G05G 1/30 |
| KR | 10-0811694 | B1 | 3/2008 | |

* cited by examiner

*Primary Examiner* — Vicky Johnson
(74) *Attorney, Agent, or Firm* — Dinsmore & Shohl LLP

(57) ABSTRACT

A mounting assembly and method for attaching a vehicle pedal assembly to a vehicle floor. A main bracket is provided wherein the main bracket having an upper surface, the main bracket is mounted to a vehicle floor. An aperture provided through the upper surface of the main bracket. A first insert mounted within the insert, the first insert configured to securely connect to the aperture of the main bracket. A second insert mounted to a bottom surface of a pedal housing, the second insert mounted within the first insert to securely connect the main bracket to the pedal housing. The first insert and the second insert rotated into a secured position.

10 Claims, 6 Drawing Sheets

MOUNTING ASSEMBLY FOR ELECTRONIC THROTTLE CONTROL ASSEMBLY

CROSS-REFERENCE TO RELATED APPLICATIONS

This application claims priority of U.S. Patent Application No. 61/810,452 filed Apr. 10, 2013, the contents of which are incorporated herein by reference.

FIELD OF THE INVENTION

The present invention relates generally to pedal assemblies. More particularly, this invention relates to a mounting bracket for a pedal assembly.

BACKGROUND OF THE INVENTION

It is well known in the art to mount a pedal assembly directly to a floor of the vehicle. This mounting typically requires use of numerous screws and/or bolts to secure the pedal assembly to the vehicle. The use of numerous bolts and/or screws is time consuming for the line worker and increases the overall production time of the vehicle. Furthermore, it is often difficult to reach the bolts to properly secure the pedal assemblies to the vehicle. Accordingly, there exists a need in the art to provide an improved means for installing a pedal assembly within a vehicle.

SUMMARY OF THE INVENTION

A mounting assembly and method for attaching a vehicle pedal assembly to a vehicle floor. A main bracket is provided wherein the main bracket having an upper planar surface, the main bracket is mounted to a vehicle floor. An aperture provided through the upper planar surface of the main bracket. A first insert mounted within the aperture, the first insert being a circular bore and configured to securely connect to the aperture of the main bracket. A second insert mounted to a bottom surface of a pedal housing, the second insert mounted within the first insert to securely connect the main bracket to the pedal housing.

The method comprising the steps of connecting the main bracket to a vehicle floor, inserting the first insert of a pedal housing into an aperture on a main bracket, the insert inserted at an angle relative to the main bracket, inserting the second insert into the first insert, the second insert connected to a pedal housing and rotating the first insert and the second insert to an aligned position relative to the main bracket thereby locking the pedal housing into place on the main bracket.

DETAILED DESCRIPTION OF THE INVENTION

Figure 1:
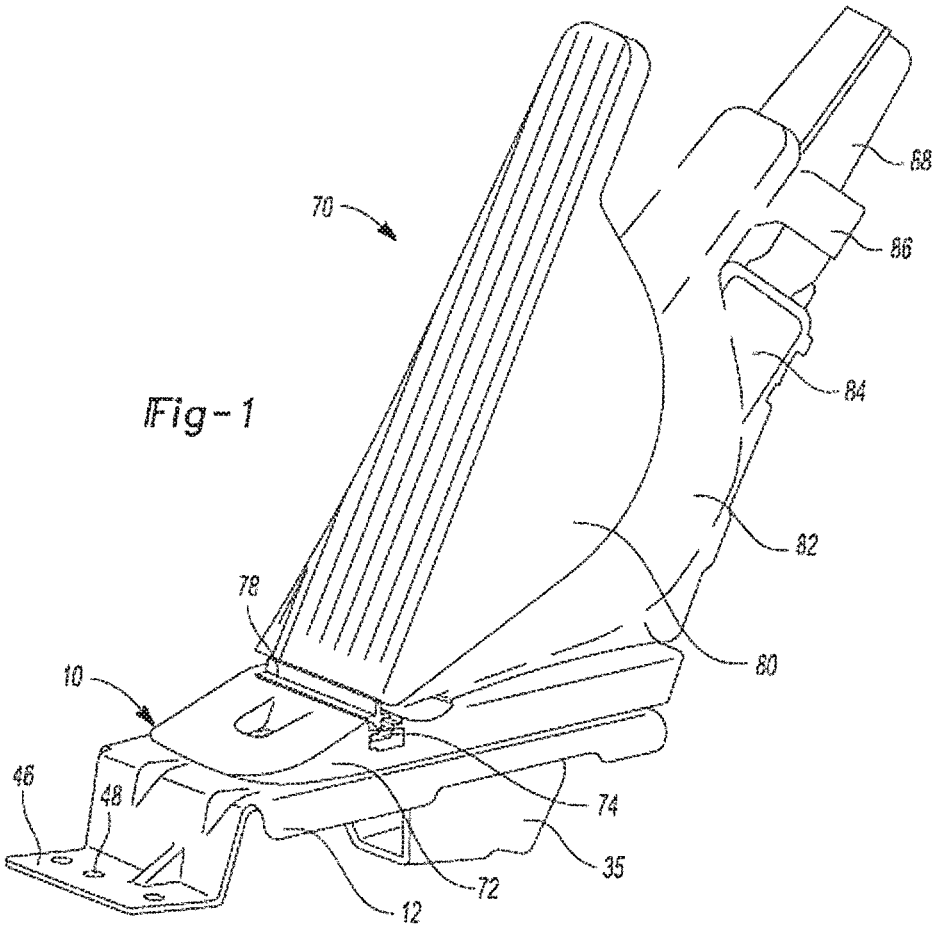
FIG. 1 illustrates a perspective view of the mounting bracket and first insert.
Figure 2:
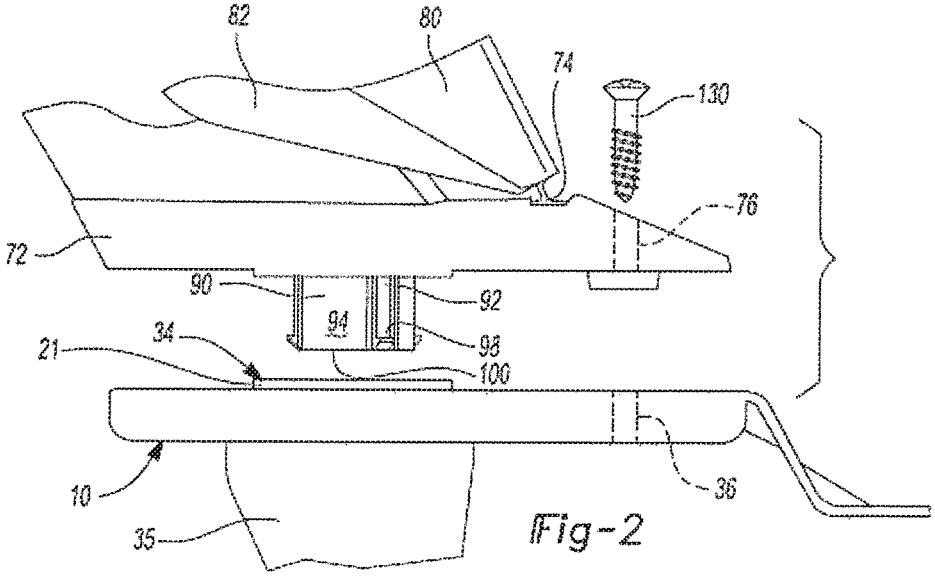
FIG. 2 illustrates a side view of the pedal housing being mounted on the main bracket, second bracket insert not shown.
Figure 3:
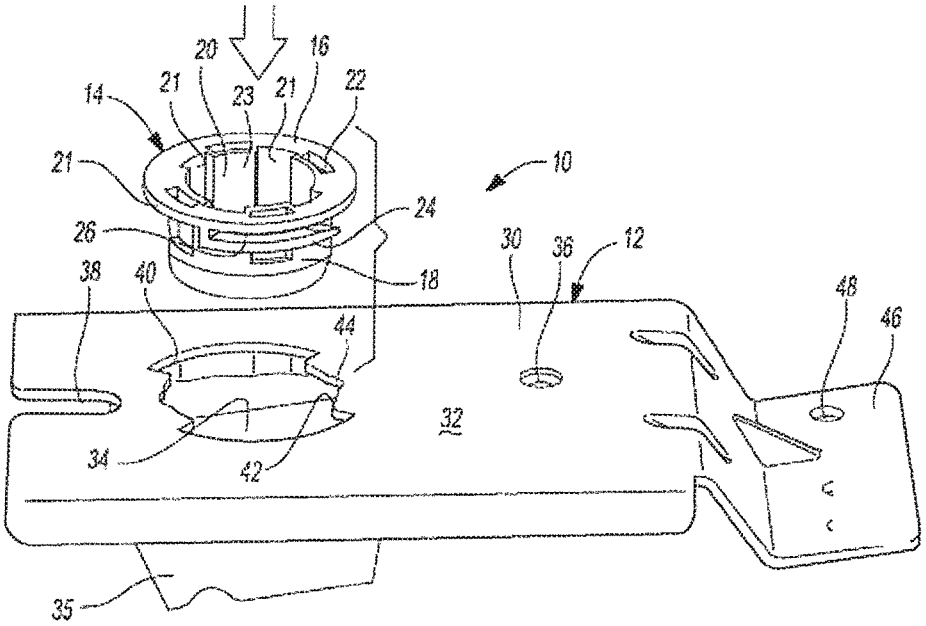
FIG. 3 illustrates a perspective view of the first insert being inserted into the main bracket.

The present invention provides for an improved mounting apparatus for installation of a pedal assembly to a vehicle. The mounting bracket and bracket insert allow for a simplified installation of a pedal assembly within a vehicle. The assembly includes a main mounting bracket and two bracket insert operable to rotate and snap into place. The pedal assembly is then rotated into place and secured with a single bolt into the main bracket. The assembly allows the installer to reduce the overall time required in installing the pedal assembly. The twist and lock configuration greatly simplifies installation and removal for service. To remove the pedal assembly, the user removes the single bolt and rotates the assembly to unlock and remove.

A mounting assembly for attaching a vehicle pedal assembly to a vehicle floor includes a main bracket, the main bracket having an upper planar surface, the main bracket mounted to a vehicle floor. The assembly further includes an aperture provided through the upper planar surface of the main bracket. A first insert is mounted within the aperture, the first insert having an inner peripheral surface and an outer peripheral surface. The inner peripheral surface is a circular bore that includes at least two arcuate recesses and at least one outwardly arcuate surface disposed between the at least two arcuate recesses. The first insert is configured to securely connect to the aperture of the main bracket rivet operation. A second insert is provided mounted to a bottom surface of a pedal housing, the second insert mounted within the first insert to securely connect the main bracket to the pedal housing. The mounting assembly further including at least one protrusion extending away from the inner peripheral edge of the aperture towards a center portion of the aperture.

The first insert includes at least one extended portion adapted to receive at least one protrusion of the aperture. The main bracket includes a first fastener aperture extending therethrough. The pedal housing includes a second fastener aperture extending therethrough. A fastener further connects the pedal assembly to the main bracket by extending a fastener though both the first fastener aperture and the second fastener aperture. A pedal connects to the pedal housing by a living hinge. The main bracket further includes a lower surface. A support bracket is provided extending down from the lower surface of the main bracket to further support the main bracket. During installation, the first insert and the second insert are simultaneously rotated into a locked position.

FIGS. 1-8 illustrate various views of the mounting assembly 10. Now referring to the figures. The mounting assembly 10 includes a main bracket 12 and a bracket insert 14. The first bracket insert 14 is a circular bore, and includes an outer peripheral surface 18 and an inner peripheral surface 20. The inner peripheral surface 20 is comprised of at least two arcuate recesses 21 and at least one outwardly arcuate surface 23 disposed between the at least two arcuate recesses 21. Further, the inner peripheral surface 20 is configured to accept the various geometries of the pedal assembly and pedal assembly mounting features. The first bracket insert 14 further includes apertures 22 configured to accept various tabs and connectors of the pedal assembly during mounting.

The main bracket 12 includes a first portion 30 having an upper surface 32. The upper surface 32 includes a main aperture 34 and a bolt aperture 36. The main aperture 34 is configured to accept the first bracket insert 14. Further structural supports 35 are provided to support the mounting assembly 10.

The main aperture 34 includes an inner peripheral edge 40. At least two protrusions 42 are provided extending away from the inner peripheral edge 40 into a center portion of the main aperture 34. The protrusion 42 includes an indentation 44 provided on an outer peripheral surface 45 of the protrusion 42.

The protrusions 42 are configured to interact with the extended portions 24 of the bracket insert 14. The extended portions 24 of the bracket insert 14 extend away from the outer surface 18 of the bracket insert 14. The protrusion 26 of the bracket insert 14 is operable to connect with the indentation 44 located on the protrusion 42 of the main bracket 12. The bracket insert 14 is inserted into the aperture 34. The installer then rotates the bracket insert 14 until the protrusion 26 connects with the indentation 44. When the protruding 44, the bracket insert 14 snaps and locks into place. The inserts are then riveted to the bracket 12.

The main bracket 12 includes an angled and downward extending portion 46 having a plurality of apertures 48. The downward extending portion 46 connects with a floor of a vehicle. A plurality of bolts or screws are used to connect the main bracket 12 to the floor and extend through the apertures 48. A slot 38 located on the opposite end of the extended portion 46 is configured to accept various other structural requirements of the vehicle.

The aperture 36 disposed on the upper surface 32 of the main bracket 12 is used to connect the pedal assembly to the mounting assembly 10. Further structure in connection utilizing the aperture 36 will be shown in the following drawings and discussed below.

Figure 6:
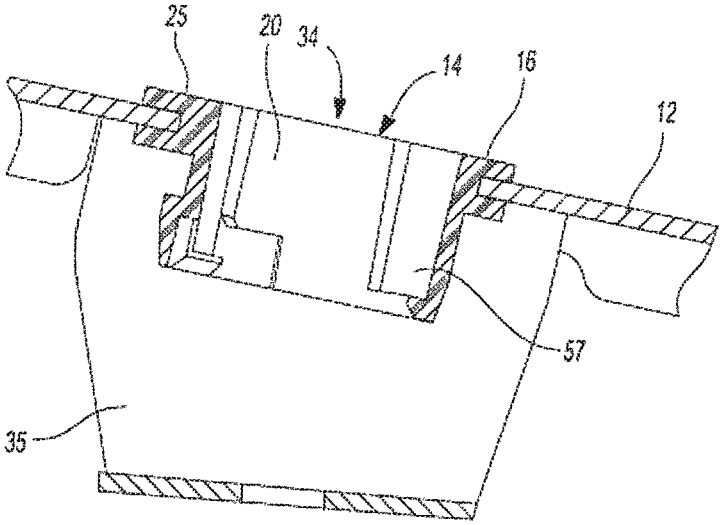
FIG. 6 illustrates a side cross-sectional view of the first insert installed into the aperture to the main bracket.

Various structural elements 50, 52 are illustrated in a fully installed and locked position. FIG. 6 further illustrates geometry 54, 56 of the bracket insert 14. These indentations 54, 56 are configured to accept the geometry of the pedal assembly when in an installed position.

The pedal assembly 70 includes a mounting portion 72 which connects directly to the mounting assembly 10 and the main bracket 12 in the bracket insert 14.

Figure 8:
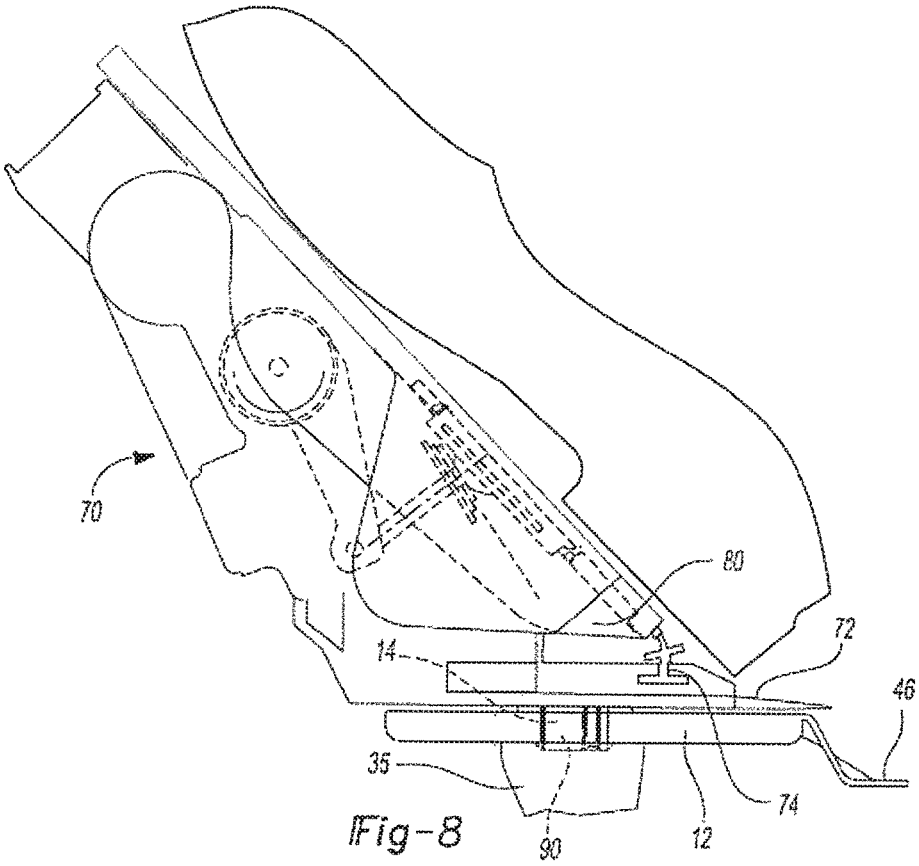
FIG. 8 illustrates a side and partial cross-sectional view of the pedal assembly of the present invention, second insert not shown.

The pedal assembly 70 further includes a connection portion 74, 78. The pedal assembly 70 includes a pedal pad 80, 82 in various electronic throttle control devices 84, 86. The pedal assembly 70 is mounted to and within the housing 88. FIG. 8 illustrates an alternative environmental view of a typical pedal assembly 70 used in connection with the mounting assembly 10 of the present invention. This pedal assembly 70 includes various connection features and hysteresis devices used in an electronic throttle control assembly.

The pedal assembly 70 and mounting portion 72 of the pedal assembly 70 are spaced away from an exploded view from the mounting assembly 10. The mounting portion 10 includes a second insert 90 having a plurality of tabs 92 disposed on an outer surface 94. The second insert 90 of the mounting portion 72 is generally circular to accommodate the structure of the inner surface 20 of the bracket insert 14. The second insert is mounted to a bottom surface of the pedal housing.

Figure 4:
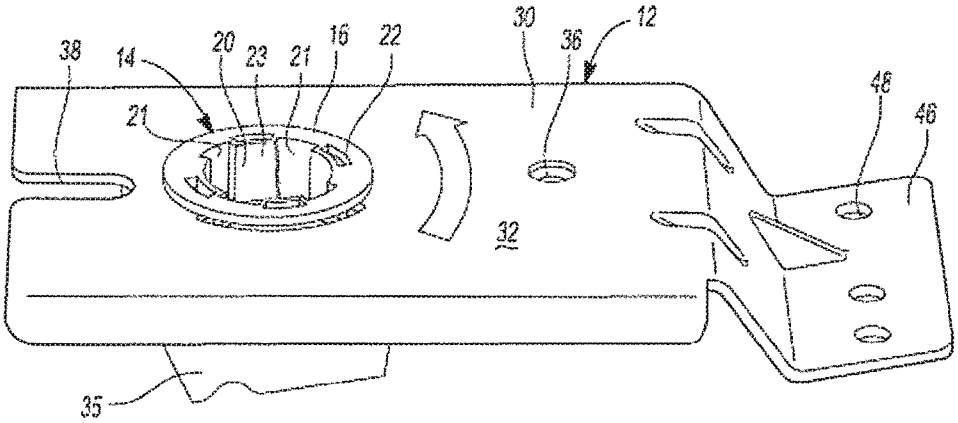
FIG. 4 illustrates a perspective view of the first insert being rotated into a locked position.
Figure 5:
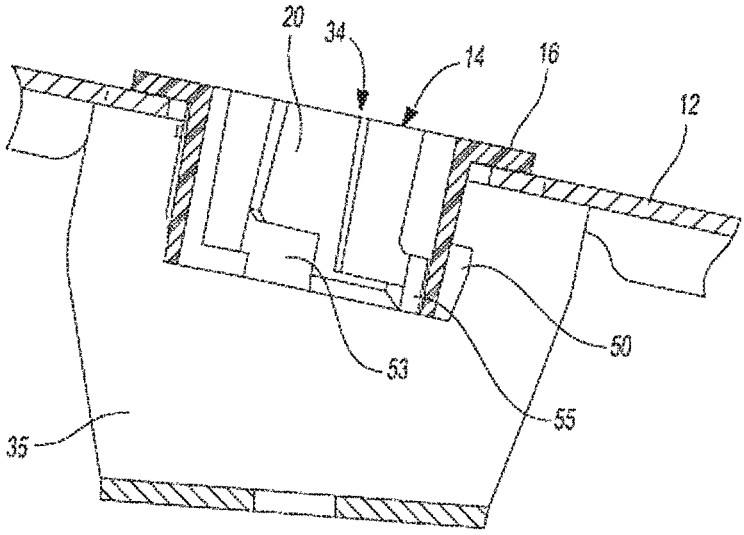
FIG. 5 illustrates a side cross-sectional view of the first insert installed into the aperture to the main bracket.

In one embodiment, the tabs 92 include an angled portion 98. The tabs 92 include the angled portion 98 at a free end of the tab 92. The tabs 92 are generally rectangular and fixed at one end, thereby giving some flexibility to the tab 92 during insertion into the bracket insert 14. The tabs 92 and inclined portions 98 are configured to connect with geometry on the inner surface 20 of the bracket insert 14, as shown in the cross-sectional views as shown in FIGS. 4 and 5 at reference numerals 3, 55, 57. The second insert 90 further includes structural support 110 extending and crossing through a center portion of the connection portion 90. FIG. 11 further demonstrates connections 110, 112 for slideably connecting the pedal assembly to the main bracket 12.

Figure 7:
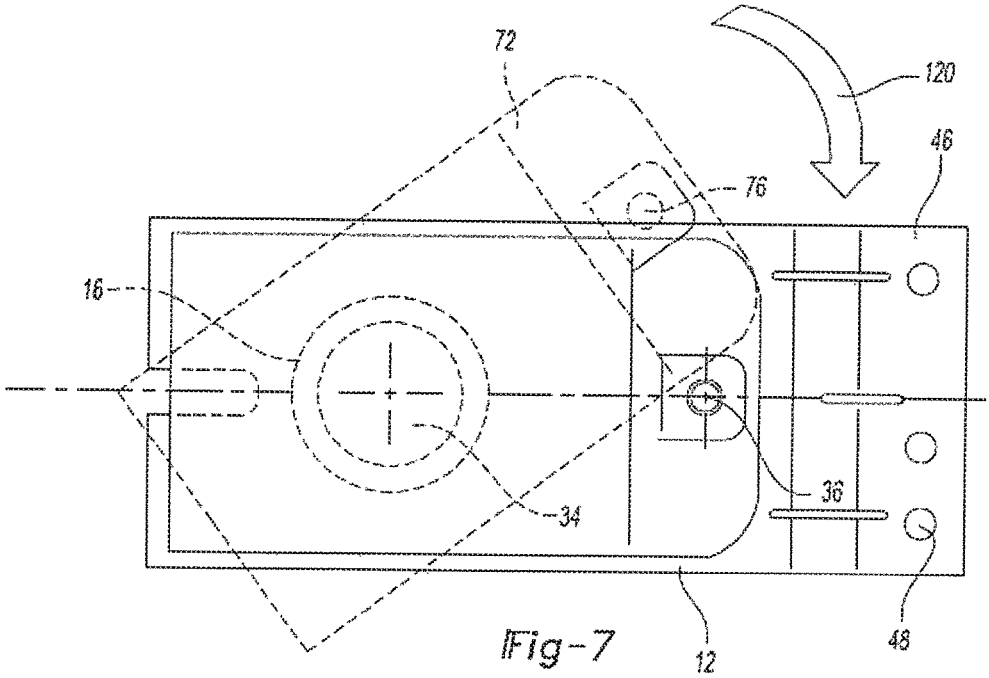
FIG. 7 illustrates the pedal housing being rotated into place on the main bracket.

FIG. 7 illustrates the rotational movement of the pedal assembly 70 when mounting onto the main bracket 12 and into the bracket insert 14. FIG. 7 illustrates that the pedal assembly and the second insert 90 are positioned at an angle of approximately 20° with respect to the main bracket 12 and the first insert 14. The connection portion 90 of the pedal assembly 70 is inserted into the bracket insert 14 at a generally 20° angle. This angle may vary depending on the specific geometry as required by various customers. The pedal is rotated into place thereby twisting and locking the first insert, the second insert and the pedal (and pedal housing) into place.

The method of installing a pedal assembly within a vehicle includes the steps of connecting a main bracket to a vehicle floor, inserting a first insert of a pedal housing into an aperture on a main bracket, the insert inserted at an angle relative to the main bracket, inserting a second insert into the first insert, the second insert connected to a pedal housing and rotating the first insert and the second insert to an aligned position relative to the main bracket thereby locking the pedal housing into place on the main bracket. The method of installing the pedal assembly further includes the step of aligning the pedal housing to the main bracket. The method of installing the pedal assembly further includes the step of securing the pedal assembly to the main bracket with a bolt. The method of installing the pedal assembly further including the step of mounting a pedal to the pedal housing.

Once the pedal assembly and second insert 90 is mounted into the first bracket insert 14, the installer then rotates the pedal assembly in a clockwise direction as shown by directional arrow 120 to align the pedal assembly 70 with the main bracket 12 bringing the angle of displacement back to 0°. As the pedal assembly is rotated into place within the bracket insert 14, the various tabs and connection portions of the connection portion 14 connect with the inner surface and geometry of the inner surface 20 of the first insert 14 to snap into place and secure the pedal assembly 70 to the mounting assembly 10.

The installer then secures the pedal assembly 70 to the main bracket 12 by means of a bolt or screw 130 through the aperture 76 and also through the aperture 36 of the main bracket 12. This single bolt 130 used in connection with the second insert 90, the bracket insert 14 and the main bracket 12 are used to simplify the installation process of the pedal assembly 70 to a vehicle.

Figure 9:
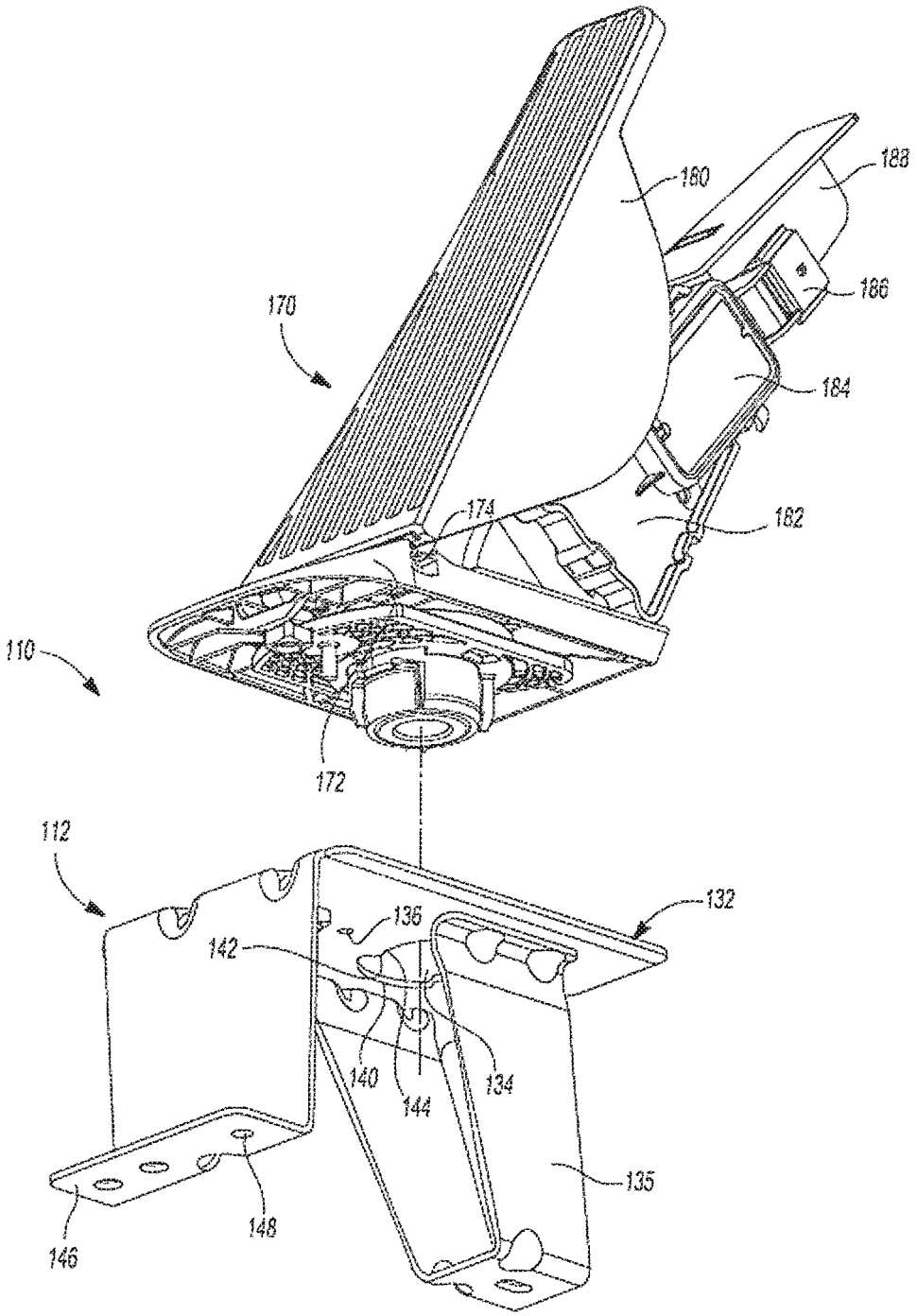
FIG. 9 illustrates a perspective view of an alternative embodiment of the present invention.
Figure 10:
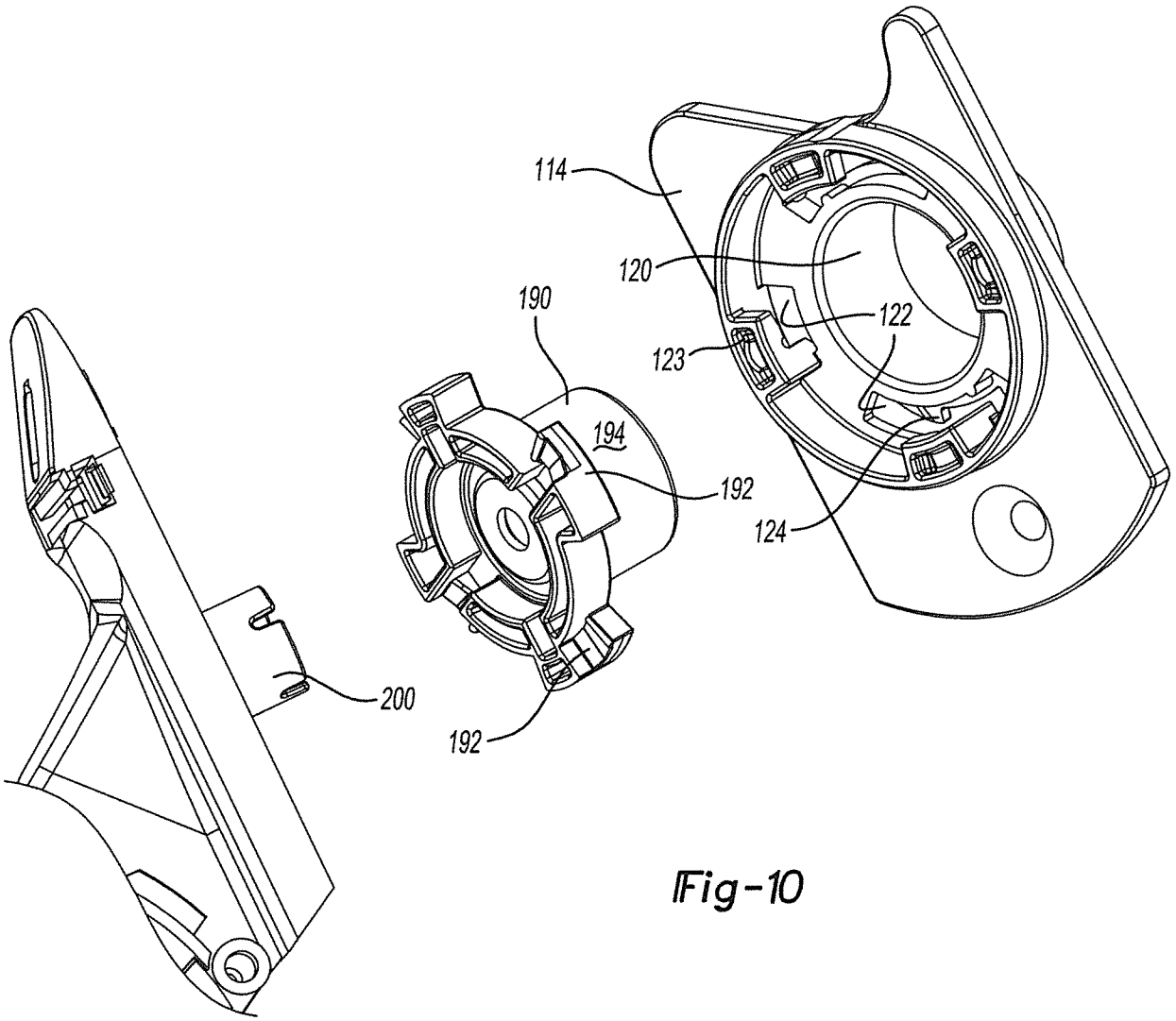
FIG. 10 illustrates an exploded perspective view of an alternative embodiments of the present invention, the housing insert is mounted to the bottom of the housing by a screw before it locks into the housing).

FIGS. 9 and 10 illustrate an alternative embodiment of the pedal assembly. The assembly 170. The mounting assembly 10 includes a main bracket 112 and a first bracket insert 114. The first bracket insert 114 includes an outer peripheral surface 118. An inner peripheral surface 120 is further provided including various geometries for accepting the pedal assembly and pedal assembly mounting features. The first bracket insert 114 further includes apertures 122 configured to accept various tabs and connectors of a second bracket insert 190 during mounting.

The main bracket 112 includes a first portion having an upper surface 32. The upper surface 132 includes a main aperture 134 and a bolt aperture 136. The main aperture 134 is configured to accept the first bracket insert 114. Further structural supports 135 are provided to support the mounting assembly 110.

The main aperture 134 includes an inner peripheral edge 140. At least two protrusions 142 are provided extending away from the inner peripheral edge 140 into a center portion of the main aperture 134.

The protrusions 142 are configured to interact with the extended portions 124 of the bracket insert 114. The protrusion 126 of the bracket insert 114 is operable to connect with the indentation 144 located on the protrusion 142 of the main bracket 112. The bracket insert 114 is inserted into the aperture 134. The bracket insert 114 is also mounted directly to the pedal housing. The installer then rotates the bracket insert 114 until it is in a locked position.

The main bracket 112 includes an angled and downward extending portion 146 having a plurality of apertures 148. The downward extending portion 146 connects with a floor of a vehicle. A plurality of bolts or screws are used to connect the main bracket 112 to the floor and extend through the apertures 148.

The aperture 136 disposed on the upper surface 132 of the main bracket 112 is used to connect the pedal assembly to the mounting assembly 110. Further structure in connection utilizing the aperture 36 will be shown in the following drawings and discussed below.

The pedal assembly 170 includes a mounting portion 172 which connects directly to the mounting assembly 110 and the main bracket 112 and the bracket insert 114.

The pedal assembly 170 further includes a connection portion 174. The pedal assembly 170 includes a pedal pad 180, 182 in various electronic throttle control devices 184, 186. The pedal assembly 170 is mounted to and within the housing 188. FIG. 8 illustrates an alternative environmental view of a typical pedal assembly 170 used in connection with the mounting assembly 110 of the present invention. This pedal assembly 170 includes various connection features and hysteresis devices used in an electronic throttle control assembly.

The pedal assembly 170 and mounting portion 172 of the pedal assembly 170 are spaced away from an exploded view from the mounting assembly 110. The mounting portion 110 includes a second insert 190 having a plurality of tabs 192 disposed on an outer surface 194. The second insert 190 is generally circular to accommodate the structure of the inner surface 120 of the bracket insert 114. The second insert is also mounted to a bottom surface of the pedal housing. A bolt connects both the first insert and the second insert together and to the pedal housing. The pedal assembly, with first insert and the second insert installed, is rotated into a secured position on the main bracket.

The tabs 192 are generally rectangular and fixed at one end, thereby giving some flexibility to the tab 192 during insertion into the bracket insert 114. The tabs 192 of the second insert are configured to connect with the apertures 122 and the tabs 123 of the bracket insert 114 and are adapted to securely when rotated into place. The pedal is rotated into place thereby twisting and locking the first insert, the second insert and the pedal (and pedal housing) into place.

Installation of this second embodiment requires mounting of the second bracket insert (or housing insert) to the housing by a screw (or bolt). This mounting occurs before it locks into the first bracket insert. The second bracket insert then mounts into the first bracket insert and rotates (generally 20° angle). This angle may vary depending on the specific geometry as required by various customers. The pedal is rotated into place thereby twisting and locking the first insert, the second insert and the pedal (and pedal housing) into place.

The invention is not restricted to the illustrated examples and embodiment described above. The embodiment is not intended as limitations on the scope of the invention. Methods, apparatus, compositions, and the like described herein are exemplary and not intended as limitations on the scope of the invention. Changes therein and other uses will occur to those skilled in the art.

The invention claimed is:

1. A mounting assembly for attaching a vehicle pedal assembly to a vehicle floor, the mounting assembly comprising:

a main bracket, the main bracket directly mounted to the vehicle floor, the main bracket having a generally planar upper surface, the generally planar upper surface spaced apart from the vehicle floor, the upper surface having a aperture;

a first insert mounted to the bracket having an inner peripheral surface and an outer peripheral surface, the inner peripheral surface having a circular bore defined by at least two arcuate recesses and at least one outwardly arcuate surface disposed between the at least two arcuate recesses, the first insert having an upper surface perpendicular with the upper surface of the main bracket, the upper surface of the first insert having at least one receiving portion, the first insert rotatably mounted within the aperture, the first insert configured to securely and rotatably connect to the aperture of the main bracket; and a second insert having at least one tab configured to connect with the at least two arcuate recesses on the inner peripheral surface of the first insert, the second insert concentrically mounted within the first insert to securely connect to the main bracket.

2. The mounting assembly of claim 1 wherein the aperture includes at least one protrusion extending away from the inner peripheral edge of the aperture towards a center portion of the aperture.

3. The mounting assembly of claim 2 wherein the first insert includes at least one extended portion adapted to receive the at least one protrusion of the aperture.

4. The mounting assembly of claim 1 wherein the main bracket includes a first fastener aperture extending therethrough.

5. The mounting assembly of claim 4 wherein the pedal assembly includes a second fastener aperture extending therethrough.

6. The mounting assembly of claim 5 wherein a fastener further connects the pedal assembly to the main bracket by extending a fastener though both the first fastener aperture and the second fastener aperture.

7. The mounting assembly of claim 1 wherein a pedal connects to the pedal assembly by a living hinge.

8. The mounting assembly of claim 1 wherein the main bracket further includes a lower surface.

9. The mounting assembly of claim 8 wherein a support bracket is provided extending down from the lower surface of the main bracket to further support the main bracket.

10. The mounting assembly of claim 1 wherein the first insert and the second insert are simultaneously rotated into a locked position.

* * * * *